US006375053B1

(12) United States Patent
Cecchinel

(10) Patent No.: US 6,375,053 B1
(45) Date of Patent: Apr. 23, 2002

(54) KNAPSACK SUPPORTED ON THE TWO SHOULDERS BY A PAIR OF SHOULDER STRAPS

(76) Inventor: Walter Cecchinel, 6 Allée des Plattières, 74290 Veyrier du Lac (FR)

( * ) Notice: Subject to any disclaimer, the term of this patent is extended or adjusted under 35 U.S.C. 154(b) by 0 days.

(21) Appl. No.: 09/353,131

(22) Filed: Jul. 14, 1999

(30) Foreign Application Priority Data

Jul. 17, 1998 (FR) ..... 98 09330

(51) Int. Cl.[7] ..... A45F 3/04; A45F 3/12
(52) U.S. Cl. ..... 224/267; 224/264; 224/643
(58) Field of Search ..... 224/627, 264, 224/637, 640, 643

(56) References Cited

U.S. PATENT DOCUMENTS 3,435,867 A * 4/1969 Hyden ..... 224/613
4,976,388 A * 12/1990 Coontz ..... 224/264
5,143,266 A * 9/1992 Heckerman et al. ..... 224/600
5,184,764 A * 2/1993 Orovan et al. ..... 224/637
5,400,934 A * 3/1995 Ducros ..... 224/627
5,411,194 A * 5/1995 Nagasawa et al. ..... 224/254
5,615,811 A * 4/1997 Bell et al. ..... 224/258
5,695,102 A * 12/1997 Jackson ..... 224/257
5,730,347 A * 3/1998 Finot ..... 224/631
6,070,776 A * 6/2000 Furnary et al. ..... 224/627

FOREIGN PATENT DOCUMENTS

FR 2670373 * 6/1992 ..... 224/202

* cited by examiner

*Primary Examiner*—Lee Young
*Assistant Examiner*—Joseph C Merek
(74) *Attorney, Agent, or Firm*—Richard P. Gilly

(57) ABSTRACT

This invention relates to a knapsack, such as a rucksack or satchel, supported on the two shoulders by a pair of shoulder straps. The upper part of each shoulder strap includes an elastic portion with limited elongation.

12 Claims, 2 Drawing Sheets

KNAPSACK SUPPORTED ON THE TWO SHOULDERS BY A PAIR OF SHOULDER STRAPS

FIELD OF THE INVENTION

The present invention relates to a knapsack supported on the two shoulders by means of a pair of straps, typically a backpack or a satchel.

BACKGROUND OF THE INVENTION

A knapsack of this type, whether it is a satchel or a bag for sportsman or hiker, is frequently induced to bump against the wearer's back. A schoolboy might run or jump. A sportsman (gliding over snow, practicing motocross, riding a mountain-bike, climbing, or hiking for sport) will transmit all sorts of outside shocks or aggressions to the bag which he is carrying on his back.

The invention aims at separating the knapsack with respect to the person wearing it, on the one hand to improve the comfort of carrying a knapsack of this type, allowing the wearer of the bag to feel the generally sudden, and more or less frequent, movements of the bag when practicing sport or when the user is moving, less on his shoulders, and, on the other hand, reducing the effect of the sudden movements of the user on the contents of the bag itself.

SUMMARY OF THE INVENTION

To that end, it relates to a knapsack supported on the two shoulders by means of a pair of shoulder straps passing around the shoulders, each strap having an upper end which is fixed to the bag in the upper half thereof, characterized in that

- each of the two shoulder straps comprises an elastic portion which comprises means for limiting its elongation in the case of traction,
- and this elastic portion is localized in the area of the upper end of this shoulder strap.

BRIEF DESCRIPTION OF THE DRAWINGS

The invention will be more readily understood on reading the following description of two non-limiting embodiments of a knapsack according to the invention, with reference to the accompanying drawings, in which.

DESCRIPTION OF PREFERRED EMBODIMENTS

Figure 1:
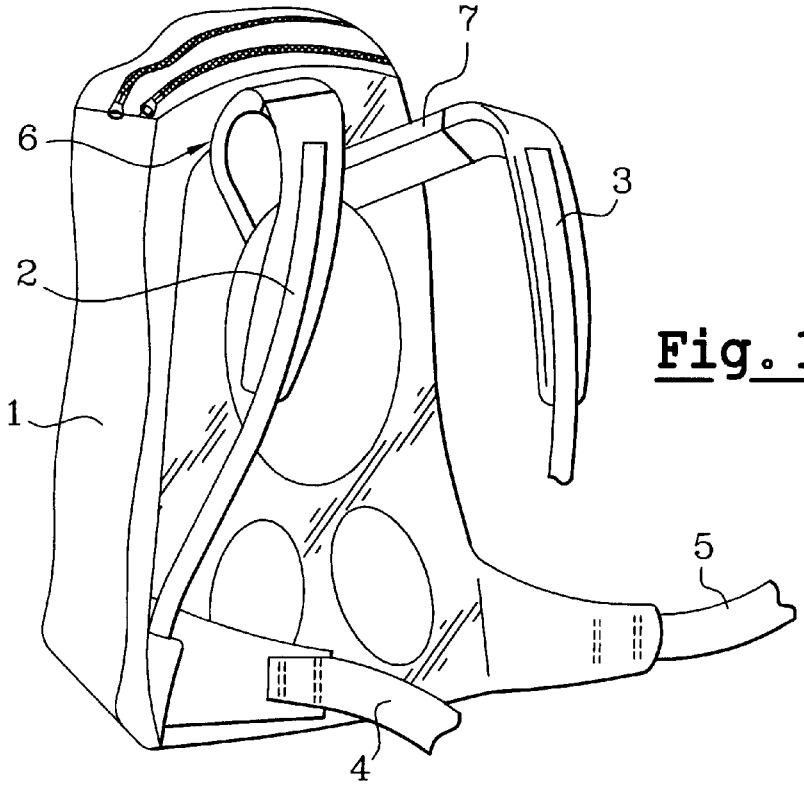
FIG. 1 is an overall view, partial and in perspective, of this knapsack provided with shoulder straps according to the invention.

Referring now to the drawings, and firstly to FIG. 1, a knapsack for sportsman or hiker is shown, which conventionally comprises a dorsal bag element 1, two supporting shoulder straps 2, 3 which are positioned around the two shoulders and which are fixed to the bag in the upper half thereof, and an abdominal belt in two parts 4, 5.

According to the invention, and in order to absorb the shocks made by the bag on the wearer in the event of the latter's body making a sudden movement, a fraction of length of each shoulder strap 2, 3 is constituted, in the area of the upper end of these shoulder straps, by elastic portions 6, 7 comprising means for limiting the elongation thereof in the event of traction exerted, generally sharply, on these shoulder straps 2, 3.

Numerous known means for producing an elastic portion with limited stretch length exist, for example as disclosed in documents U.S. Pat. No. 1,784,371, U.S. Pat. No. 4,976,388 and WO-A94/16595. Such known devices might be used here.

Figure 2:
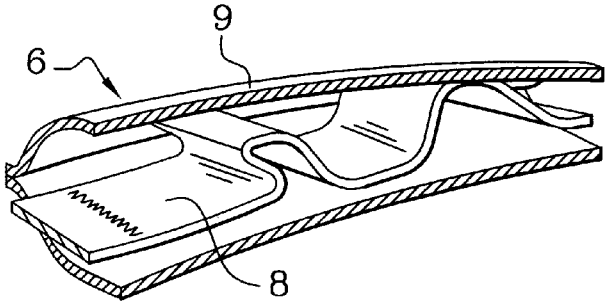
FIG. 2 shows in cut-away perspective a complex elastic portion associated, in accordance with the invention, with one of the shoulder straps of this bag, in position of rest in the absence of shock absorbed by the bag.
Figure 3:
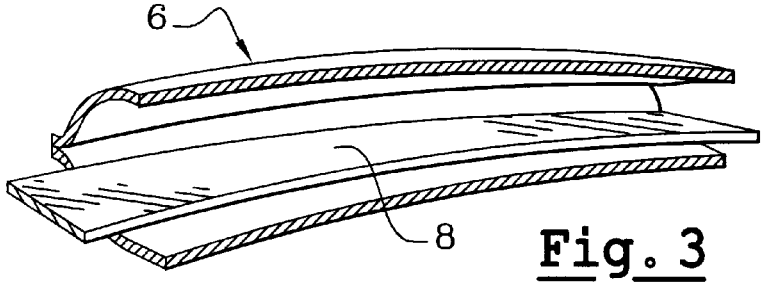
FIG. 3 is a view similar to FIG. 2, in position of maximum limited extension, acquired in the case of shock absorbed by the bag.

However, another device is used here, shown in FIGS. 2 and 3, in which elastic portion 6, 7 each comprise a non-elastic portion 8, for example made of polyamide, which is stitched so as to be slack at rest, inside a sheath 9 made of elastic material, for example synthetic rubber, as shown in FIG. 2.

In the event of a shock, the sheath 9 extends under the effect of the traction then exerted by the bag element 1 on the corresponding shoulder strap 2, such elongation being stopped when, as shown in FIG. 3, the inner band 8 has passed from a slack state to a stretched state. The same applies to the elastic portion 7 of shoulder strap 3.

In accordance with a typical embodiment, and in order to give a non-limiting idea, each elastic portion 6, 7 has, at rest, a length of the order of about fifteen centimeters and may, in the event of shock, stretch by one to some centimeters.

Each elastic portion 6, 7 is connected to its shoulder strap 2, 3 and/or the bag element 1, by stitching, riveting or welding.

Figure 4:
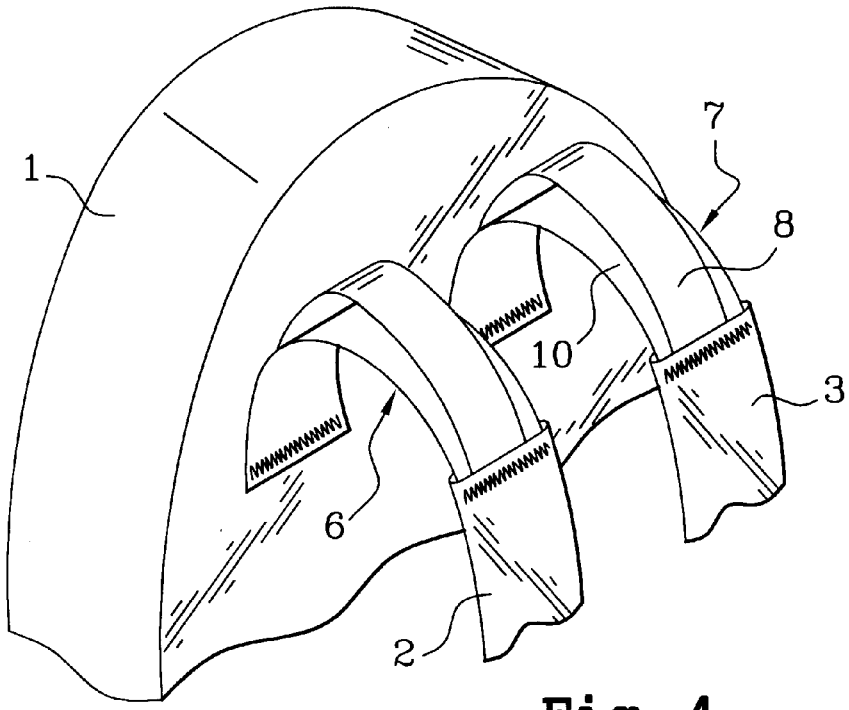
FIG. 4 is a view similar to FIG. 1 but limited to the upper area comprising the elastic portions of the shoulder straps, of another embodiment of this knapsack.

FIG. 4 illustrates a variant embodiment which differs from the preceding one in that each elastic portion 6, 7, whose length is of the order of fifteen centimeters to give an idea, is composed of two bands placed one on the other and stitched in parallel at their respective ends, as shown:

- a non-elastic portion 8, for example made of polyamide,
- and an elastic portion 10, for example made of synthetic rubber, the non-elastic portion 8 being slightly longer than the elastic portion 10.

The length of the portion 8 is greater than that of portion 10 by a value such that it limits the possible stretching of this portion 10 to one to some centimeters.

The elastic material 9, 10 of the portions 6, 7 may possibly be a visco-elastic material, advantageously presenting the property of absorbing sudden shocks and stretchings.

What is claimed is:

1. Knapsack supported on two shoulders by means of a pair of shoulder straps passing around the shoulders, wherein:

- each of the two shoulder straps comprises an inelastic portion and an elastic portion, the elastic portion having first and second opposite ends, the first end meeting at and attached to the knapsack and the second end attached to the inelastic portion, the elastic portion having means for limiting its elongation in the case of traction.

2. The bag of claim 1, wherein each elastic portion presents, at rest, a length of about fifteen centimeters.

3. The bag of claim 1, wherein each of the elastic portions comprises a sheath of elastic material and the limiting means comprises a non-elastic band which is stitched, so as to be slack at rest, inside the sheath.

4. The bag of claim 1, wherein each of said elastic portions comprises an elastic band and the limiting means comprises a non-elastic band, the elastic band and the non-elastic band being placed one on the other and having respective ends stitched in parallel, the length between the stitched ends of said non-elastic band being slightly greater than the length between the ends of said elastic band.

5. The bag of claim 1, wherein said elastic portions comprise visco-elastic material.

6. A knapsack, comprising:

a dorsal bag element;

a pair of shoulder straps, each shoulder having an inelastic portion and an elastic portion, the elastic portion having first and second opposite ends and extending over at least a part of the length of the shoulder strap, the first end meeting at and attached to the dorsal bag element and the second end attached to the inelastic portion;

wherein each elastic portion comprises a sheath of elastic material which stretches in response to traction and a non-elastic band having a maximum length greater than the length of the elastic sheath when the elastic sheath is not stretched, the non-elastic band being stitched in relation to the elastic sheath, the non-elastic band being slack when the elastic sheath is not stretched, the stretching of the elastic sheath being stopped when the non-elastic band reaches the maximum length.

7. The knapsack of claim 6, wherein the non-elastic band has a plurality of folds when it is slack inside the elastic sheath.

8. The knapsack of claim 6, wherein the elastic sheath has a length of about fifteen centimeters when it is not subjected to a traction.

9. The knapsack of claim 6, wherein the elastic sheath is made of a viscoelastic material.

10. The knapsack of claim 6, wherein each elastic portion is localized in the upper end of each of the shoulder straps.

11. A knapsack, comprising:

a dorsal bag element;

a pair of shoulder straps, each shoulder strap having an inelastic portion and an elastic portion, the elastic portion having first and second opposite ends and extending over at least a part of the length of the shoulder strap, the first end meeting at and attached to the dorsal bag element and the second end attached to the inelastic portion;

wherein each elastic portion comprises an elastic band which stretches in response to traction and a non-elastic band having a maximum length greater than the length of the elastic band when the elastic band is not stretched, the elastic band and the non-elastic band being placed one on the other and having respective ends stitched in parallel, the length between the stitched ends of said non-elastic band being slightly greater than the length between the stitched ends of said elastic band, the stretching of the elastic band being stopped when the non-elastic band reaches its maximum length.

12. The knapsack of claim 11, wherein each elastic portion is localized in the upper end of each of the shoulder straps.

* * * * *